US012446695B2

(12) United States Patent
Saeliu et al.

(10) Patent No.: US 12,446,695 B2
(45) Date of Patent: Oct. 21, 2025

(54) TRAVEL PILLOW

(71) Applicant: Pluto Brand Inc., Cty of Industry, CA (US)

(72) Inventors: Susana Saeliu, La Habra Heights, CA (US); Kevin Li, Diamond Bar, CA (US)

(73) Assignee: Pluto Brand Inc., City of Industry, CA (US)

( * ) Notice: Subject to any disclaimer, the term of this patent is extended or adjusted under 35 U.S.C. 154(b) by 355 days.

(21) Appl. No.: 18/063,780

(22) Filed: Dec. 9, 2022

(65) Prior Publication Data

US 2023/0190000 A1 Jun. 22, 2023

Related U.S. Application Data

(60) Provisional application No. 63/292,005, filed on Dec. 21, 2021.

(51) Int. Cl.
*A47G 9/10* (2006.01)
*A47C 7/38* (2006.01)
*A47G 9/00* (2006.01)

(52) U.S. Cl.
CPC ..... *A47C 7/383* (2013.01); *A47G 9/1081* (2013.01); *A47G 2009/1018* (2013.01)

(58) Field of Classification Search
CPC ..... A47C 7/383; A47G 9/1081; A47G 2009/1018; A47G 9/1045
USPC ..... 5/640, 622
See application file for complete search history.

(56) References Cited

U.S. PATENT DOCUMENTS

| | | | | |
|---|---|---|---|---|
| 6,425,138 | B1 * | 7/2002 | Johnson | A42B 1/045 2/202 |
| 6,651,256 | B1 * | 11/2003 | Swift | A47G 9/10 2/202 |
| 9,788,671 | B1 * | 10/2017 | Wuerz | A41D 3/08 |
| 2017/0280902 | A1 * | 10/2017 | Chan | A47C 7/383 |
| 2020/0113339 | A1 * | 4/2020 | Dassi | A47G 9/1045 |
| 2020/0214452 | A1 * | 7/2020 | DuPré | A47G 9/1081 |

FOREIGN PATENT DOCUMENTS

| | | | | |
|---|---|---|---|---|
| DE | 4445086 A1 * | 6/1996 | | A47G 9/1081 |
| TW | M563228 U * | 7/2018 | | A47C 7/383 |

* cited by examiner

*Primary Examiner* — David R Hare
*Assistant Examiner* — Joseane E. Tejada
(74) *Attorney, Agent, or Firm* — Nixon Peabody LLP

(57) ABSTRACT

Embodiments described herein are directed to a travel pillow having a neck portion, a hood portion, and a support assembly. The neck portion includes a cavity and a rear exterior surface having one or more first mating elements. The hood portion extends from the neck portion and includes an inwardly foldable lining. The hood portion includes one or more second mating elements disposed on a front exterior surface thereof and configured to mate with the one or more first mating elements. The support assembly is insertable within the cavity. The support assembly includes an outer covering, a foam insert disposed within the outer covering, and a padding layer. The padding layer is disposed between the foam insert and an inner surface of the outer covering. The padding layer is asymmetrically distributed along a length of the support assembly.

20 Claims, 10 Drawing Sheets

TRAVEL PILLOW

This application claims the benefit of and priority to U.S. Provisional Patent Application No. 63/292,005, filed on Dec. 21, 2021, the content of which is incorporated herein by reference in its entirety.

FIELD OF THE INVENTION

The present invention relates generally to pillows, and more specifically, to travel pillows that can be customized for various positions and preferences of a user.

BACKGROUND OF THE INVENTION

Travel pillows are widely used while traveling on flights, trains, buses, automobiles, etc. While a number of different kinds of travel pillows are available on the market, they are generally configured for use in a particular position, without regard to variable and constantly changing needs and preferences of users. Accordingly, it is desirable to have a travel pillow that can be configured to be used in different ways, based on the needs or preferences of the user, to provide optimal support and comfort while traveling.

SUMMARY OF THE INVENTION

The term embodiment and like terms (e.g., implementation, configuration, aspect, example, option, etc.) are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter. This summary is also not intended to be used in isolation to determine the scope of the claimed subject matter. The subject matter should be understood by reference to appropriate portions of the entire specification of this disclosure, any or all drawings, and each claim.

According to certain aspects of the present disclosure, a travel pillow includes a neck portion, a hood portion, and a support assembly. The neck portion includes a cavity. The hood portion extends from the neck portion. The support assembly is insertable within the cavity. The support assembly includes an outer covering, a foam insert disposed within the outer covering, and a padding layer. The padding layer is disposed between the foam insert and an inner surface of the outer covering. The padding layer is asymmetrically distributed along a length of the support assembly.

According to certain aspects of the present disclosure, the cavity is disposed around a lower half of the neck portion.

According to certain aspects of the present disclosure, the neck portion includes a first side portion and a second side portion, wherein the first side portion overlaps the second side portion when the neck portion is wrapped around a human neck.

According to certain aspects of the present disclosure, the padding layer is absent from the support assembly that interfaces with a section of the first side portion that overlaps the second side portion when the neck portion is wrapped around a human neck.

According to certain aspects of the present disclosure, the first side portion and the second side portion include hook-and-loop fasteners to secure the first side portion to the second side portion when the neck portion is wrapped around a human neck.

According to certain aspects of the present disclosure, the neck portion includes one or more first mating elements disposed on the rear exterior surface thereof.

According to certain aspects of the present disclosure, the one or more first mating elements of the neck portion are disposed on one or more sections of material attached to the rear exterior surface.

According to certain aspects of the present disclosure, the rear exterior surface of the neck portion includes one or more second mating elements that are attachable to at least one of the one or more first mating elements.

According to certain aspects of the present disclosure, the hood portion includes one or more third mating elements configured to mate with at least one of the one or more first mating elements when the neck portion can be rolled into the hood portion.

According to certain aspects of the present disclosure, the hood portion comprises a top liner assembly, a central liner assembly, and a bottom liner assembly.

According to certain aspects of the present disclosure, each of the central liner assembly and the bottom liner assembly includes a left panel, a central panel, and a right panel.

According to certain aspects of the present disclosure, the central liner assembly includes at least one foam layer on each of the left panel and the right panel.

According to certain aspects of the present disclosure, the top liner assembly of the hood portion includes an inwardly foldable lining.

According to certain aspects of the present disclosure, the travel pillow includes a strap coupled to the inwardly foldable lining.

According to certain aspects of the present disclosure, the foam insert includes two peak portions that are similarly-sized and symmetrically distributed between about one hundred and sixty degrees and about two hundred degrees apart from one another when the travel pillow is wrapped around a human neck.

According to certain aspects of the present disclosure, a travel pillow includes a neck portion, a hood portion, and a support assembly. The neck portion includes a cavity and a rear exterior surface having one or more first mating elements. The hood portion extends from the neck portion. The hood portion includes one or more second mating elements configured to mate with at least one of the one or more first mating elements when the neck portion can be rolled into the hood portion. The support assembly is insertable within the cavity. The support assembly includes an outer covering, a foam insert disposed within the outer covering, and a padding layer. The padding layer is disposed between the foam insert and an inner surface of the outer covering.

According to certain aspects of the present disclosure, a travel pillow includes a neck portion, a hood portion, and a support assembly. The neck portion includes a cavity. The hood portion extends from the neck portion and includes an inwardly foldable lining. The support assembly is insertable within the cavity. The support assembly includes an outer covering, a foam insert disposed within the outer covering, and a padding layer. The padding layer is disposed between the foam insert and an inner surface of the outer covering.

According to certain aspects of the present disclosure, a support assembly configured to be placed within a travel pillow includes an outer covering, a foam insert disposed within the outer covering, and a padding layer. The padding layer is disposed between the foam insert and an inner surface of the outer covering.

According to certain aspects of the present disclosure, the foam insert of the support assembly is sewn inside the outer covering.

The above summary is not intended to represent each embodiment or every aspect of the present disclosure. Rather, the foregoing summary merely provides an example of some of the novel aspects and features set forth herein. The above features and advantages, and other features and advantages of the present disclosure, will be readily apparent from the following detailed description of representative embodiments and modes for carrying out the present invention, when taken in connection with the accompanying drawings and the appended claims. Additional aspects of the disclosure will be apparent to those of ordinary skill in the art in view of the detailed description of various embodiments, which is made with reference to the drawings, a brief description of which is provided below.

BRIEF DESCRIPTION OF THE DRAWINGS

The disclosure, and its advantages and drawings, will be better understood from the following description of representative embodiments together with reference to the accompanying drawings. These drawings depict only representative embodiments, and are therefore not to be considered as limitations on the scope of the various embodiments or claims.

Figure 1A:
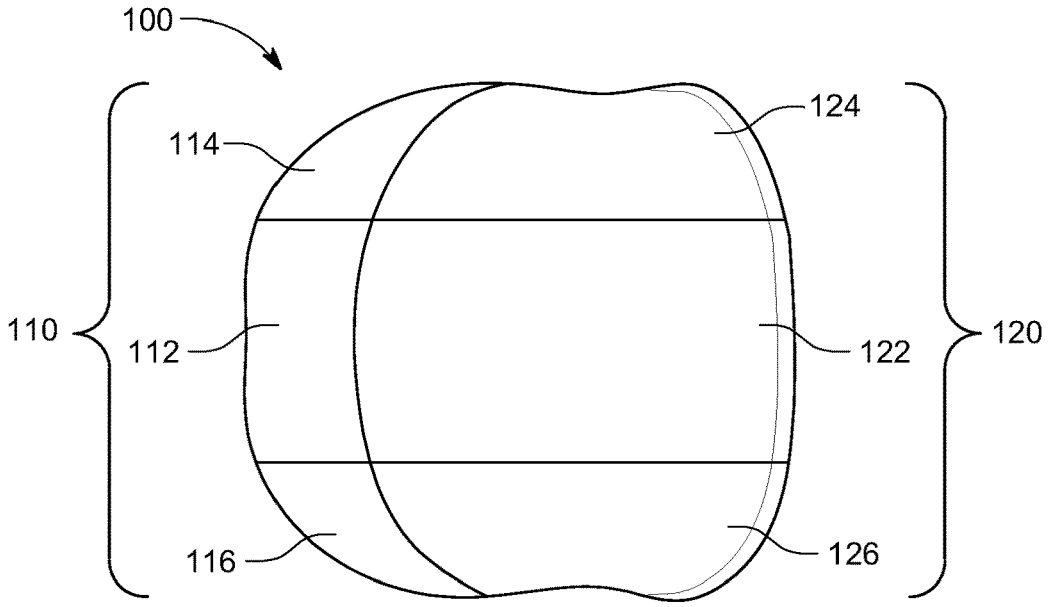
FIG. 1A is a top view of a travel pillow, according to certain aspects of the present disclosure.

The present disclosure is susceptible to various modifications and alternative forms, and some representative embodiments have been shown by way of example in the drawings and will be described in detail herein. It should be understood, however, that the invention is not intended to be limited to the particular forms disclosed. Rather, the disclosure is to cover all modifications, equivalents, and alternatives falling within the spirit and scope of the invention as defined by the appended claims.

DETAILED DESCRIPTION

Embodiments of the disclosure are directed to a travel pillow that offers optimal comfort and portability during travel. The travel pillow includes a foam insert that can be positioned around a user's neck and an adjustable hood with foam layers on the side—features, among others, that can be configured to be used in different ways to provide desired support, based on the needs and preferences of the user. At the same time, the travel pillow can be rolled up into a portable bundle that can be easily carried around during travel. Additionally, the travel pillow can include a number of features. For example, the adjustable hood can have an eye-mask that could be pulled out therefrom and cover the user's eyes if the user prefers.

Various embodiments are described with reference to the attached figures, where like reference numerals are used throughout the figures to designate similar or equivalent elements. The figures are not necessarily drawn to scale and are provided merely to illustrate aspects and features of the present disclosure. Numerous specific details, relationships, and methods are set forth to provide a full understanding of certain aspects and features of the present disclosure, although one having ordinary skill in the relevant art will recognize that these aspects and features can be practiced without one or more of the specific details, with other relationships, or with other methods. In some instances, well-known structures or operations are not shown in detail for illustrative purposes. The various embodiments disclosed herein are not necessarily limited by the illustrated ordering of acts or events, as some acts may occur in different orders and/or concurrently with other acts or events. Furthermore, not all illustrated acts or events are necessarily required to implement certain aspects and features of the present disclosure.

For purposes of the present detailed description, unless specifically disclaimed, and where appropriate, the singular includes the plural and vice versa. The word "including" means "including without limitation." Moreover, words of approximation, such as "about," "almost," "substantially," "approximately," and the like, can be used herein to mean "at," "near," "nearly at," "within 3-5% of," "within acceptable manufacturing tolerances of," or any logical combination thereof. Similarly, terms "vertical" or "horizontal" are intended to additionally include "within 3-5% of" a vertical or horizontal orientation, respectively. Additionally, words of direction, such as "top," "bottom," "left," "right," "above," and "below" are intended to relate to the equivalent direction as depicted in a reference illustration; as understood contextually from the object(s) or element(s) being referenced, such as from a commonly used position for the object(s) or element(s); or as otherwise described herein.

Referring to the figures, FIGS. 1A-1E are best understood when viewed in conjunction. FIGS. 1A-1E depict various views of a travel pillow 100. The travel pillow 100 has a neck portion 110 and a hood portion 120 extending from the neck portion 110. During use, the neck portion 110 generally wraps on or about a user's neck and the hood portion 120 generally extends over the user's head. It should be noted, however, that the hood portion 120 and/or neck portion 110 may be flexible and allow the travel pillow 100 to be used without the hood portion 120 extending over the user's head. For example, in some embodiments, the user may be able to push the hood portion 120 back such that it no longer covers the user's head but instead is positioned above the neck portion 110. The hood portion further includes an inwardly foldable lining that can be used as an eye-mask for covering the user's eyes. Additionally, though the neck portion 110 and the hood portion 120 of the travel pillow 100 depicted in FIGS. 1A-1E are separate pieces, such is not required. That is, in some embodiments, the neck portion 110 and the hood portion 120 may be crafted from a single piece of material (e.g., an exterior surface of the travel pillow 100 may be crafted from a single piece of material).

Figure 3A:
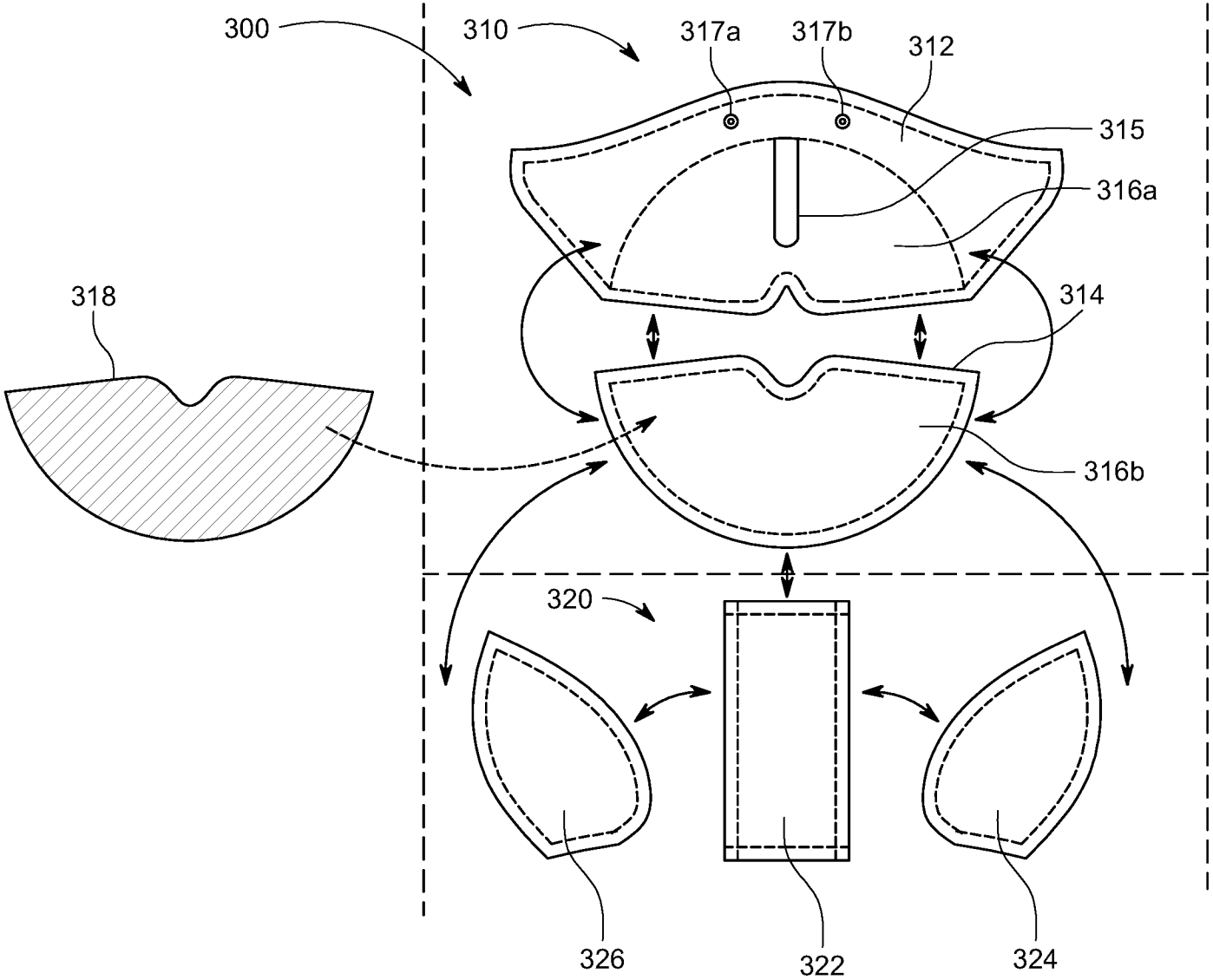
FIG. 3A is an exploded view of a top liner assembly of a hood portion attachable to a central liner assembly of the hood portion of the travel pillow, according to certain aspects of the present disclosure.
Figure 3B:
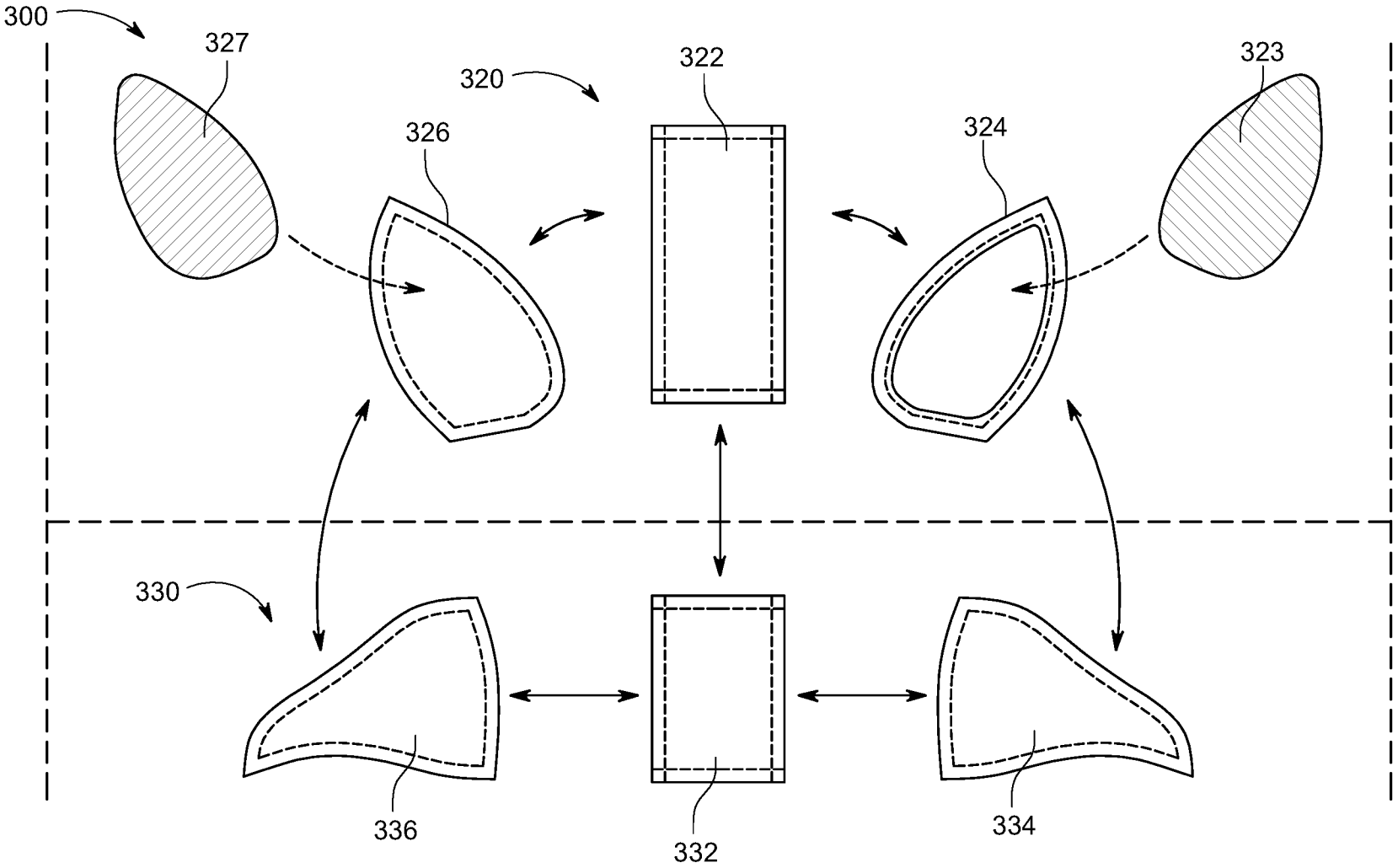
FIG. 3B is an exploded view of the central liner assembly of the hood portion attachable to a bottom liner assembly of the hood portion of the travel pillow, according to certain aspects of the present disclosure.
Figure 3C:
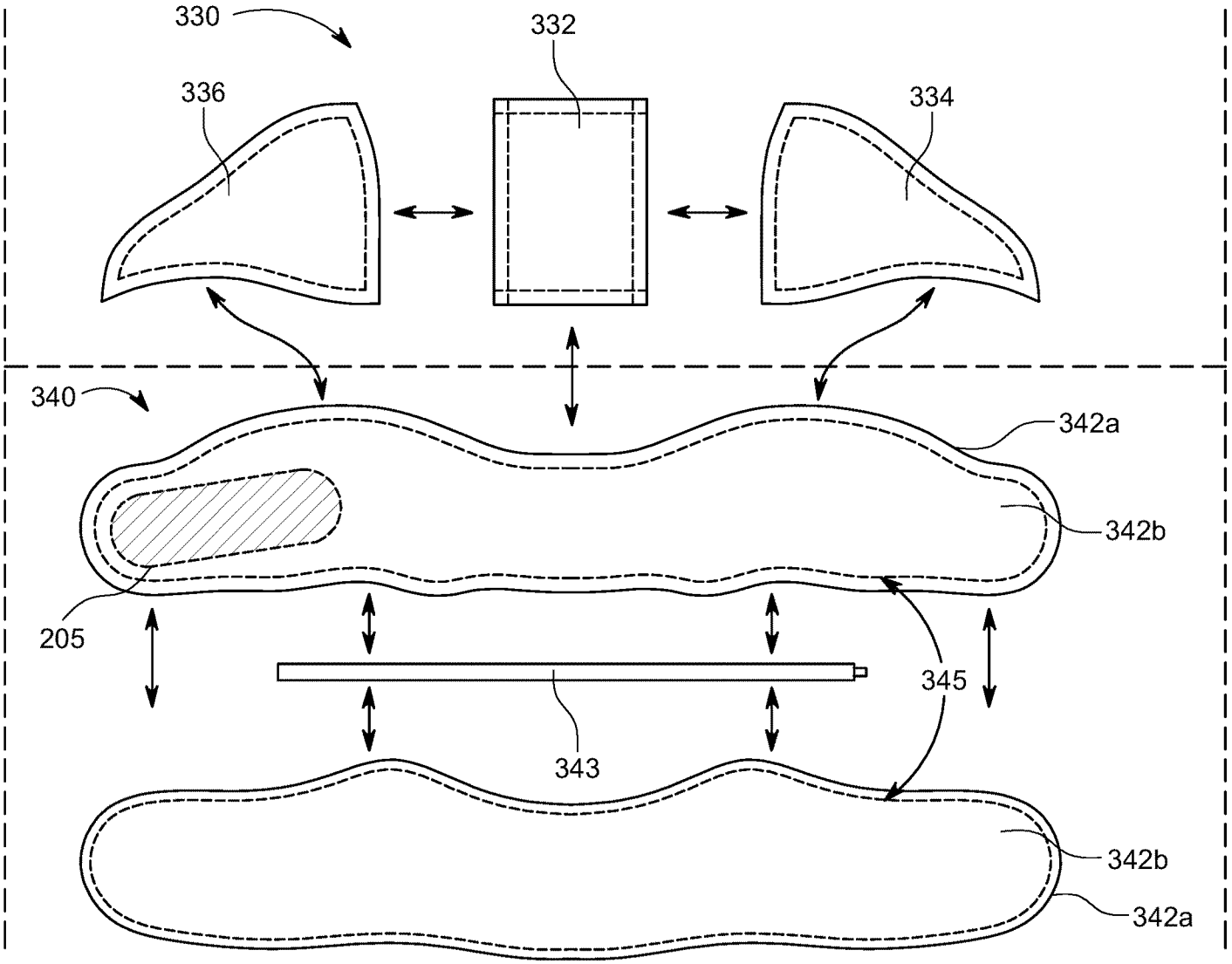
FIG. 3C is an exploded view of the bottom liner assembly attachable to a neck liner assembly of the neck portion of the travel pillow, according to certain aspects of the present disclosure.

The neck portion 110 generally includes a cavity (e.g., as shown in, and discussed in more detail with respect to, FIG. 3C). The cavity is configured to receive a support assembly (e.g., as shown in, and discussed in more detail with respect to, FIGS. 3C and 3D). The support assembly is generally a foam (or other supportive material) insert configured to provide support to the user's head and/or neck during use. In different embodiments, the support assembly may be integrally built-in within the neck portion 110, without being accessible through a cavity.

The neck portion 110 and/or the hood portion 120 can include single or multiple segments. For example, as can be seen in the example travel pillow 100 depicted in FIGS. 1A-1E, the neck portion 110 and the hood portion 120 are comprised of multiple segments. The neck portion 110 has a middle segment 112, a left segment 114, and a right segment 116. The left segment 114 of the neck portion 110 and the right segment 116 of the neck portion 110 can be similarly or differently sized. The hood portion 120 has a middle segment 122, a left segment 124, and a right segment 126. The left segment 124 of the hood portion 120 and the right segment 126 of the hood portion 102 can be similarly or differently sized.

Regardless of whether the neck portion 110 and/or the hood portion 120 includes a single segment or multiple segments, in some embodiments, the travel pillow 100 includes a first side portion 118*b* and a second side portion 118*a*. The first side portion 118*b* and the second side portion 118*a* extend from the travel pillow 100 and can be wrapped about the user's neck or a portion of the user's neck. In embodiments in which the neck portion 110 includes multiple segments, such as the example depicted in FIGS. 1A-1E, the first side portion 118*b* and the second side portion 118*a* can be part of, or extend from, the segments on the left side and the right side. For example, the right segment 116 of the neck portion 110 can include the first side portion 118*b* and the left segment 114 of the neck portion 110 can include the second side portion 118*a*. In some embodiments, the first side portion 118*b* overlaps the second side portion 118*a*, when the neck portion 110 is wrapped around the user's neck. In some embodiments, the first side portion 118*b* and the second side portion 118*a* include fasteners (e.g., hook-and-loop fasteners, snap, clips, etc.) to secure the first side portion 118*b* to the second side portion 118*a*, when the neck portion 110 is wrapped around the user's neck. The fasteners allow the user to adjust the travel pillow 100 such that the support assembly comfortably and securely supports their head and/or neck.

In some embodiments, one or more of the first side portion 118*b* and the second side portion 118*a* can include a neck tag 105. For example, as depicted in FIG. 1D, the first side portion 118*b* includes the neck tag 105. The user can utilize the neck tag 105 to aid in pulling the first side portion 118*b* over the second side portion 118*a*. The neck tag 105 can be made from any suitable material such as, cloth, leather, synthetic materials such as ultra suede, etc.

Figure 2A:
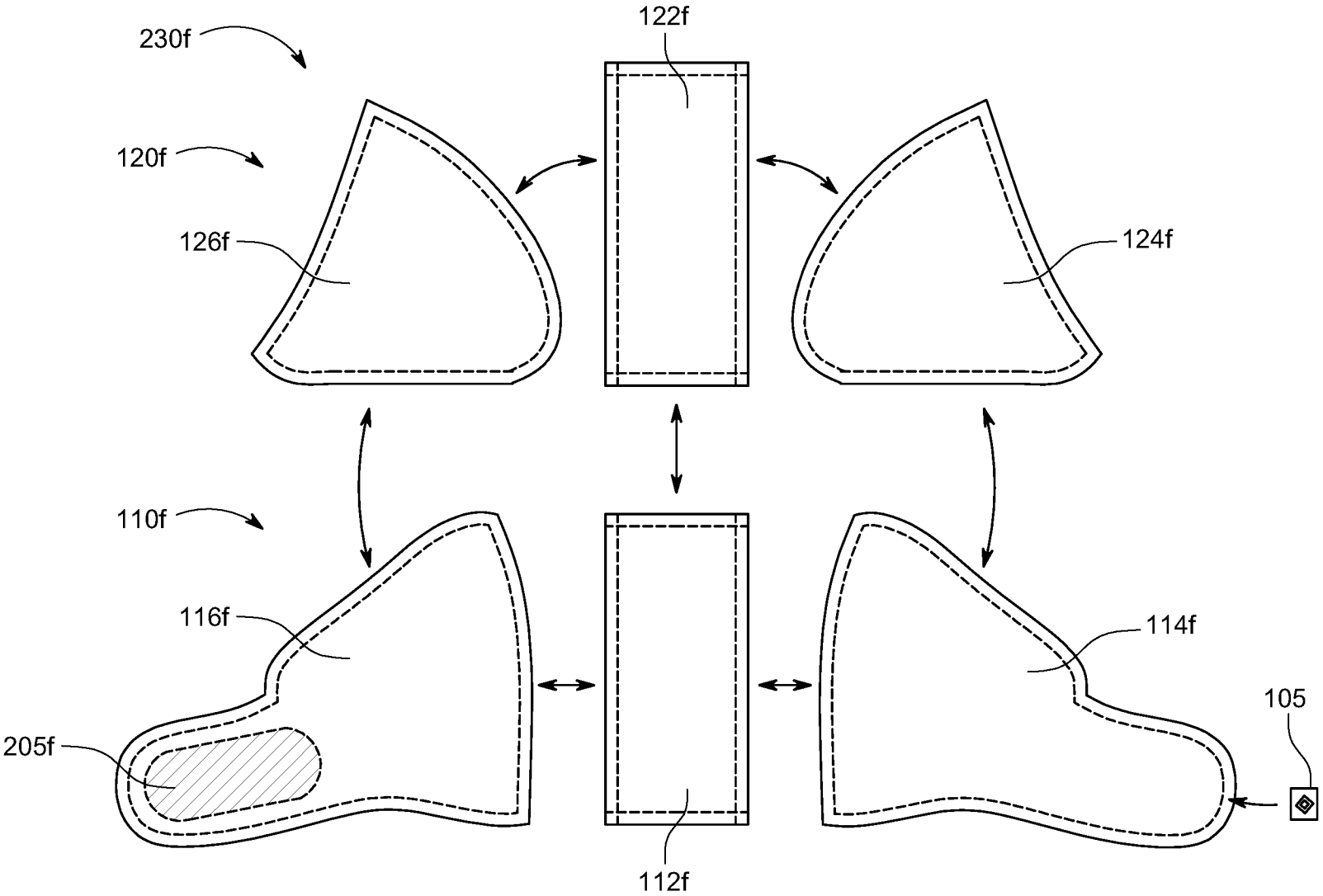
FIG. 2A is an exploded view depicting components of the front exterior surface of the travel pillow having a hood portion and a neck portion, according to certain aspects of the present disclosure.
Figure 2B:
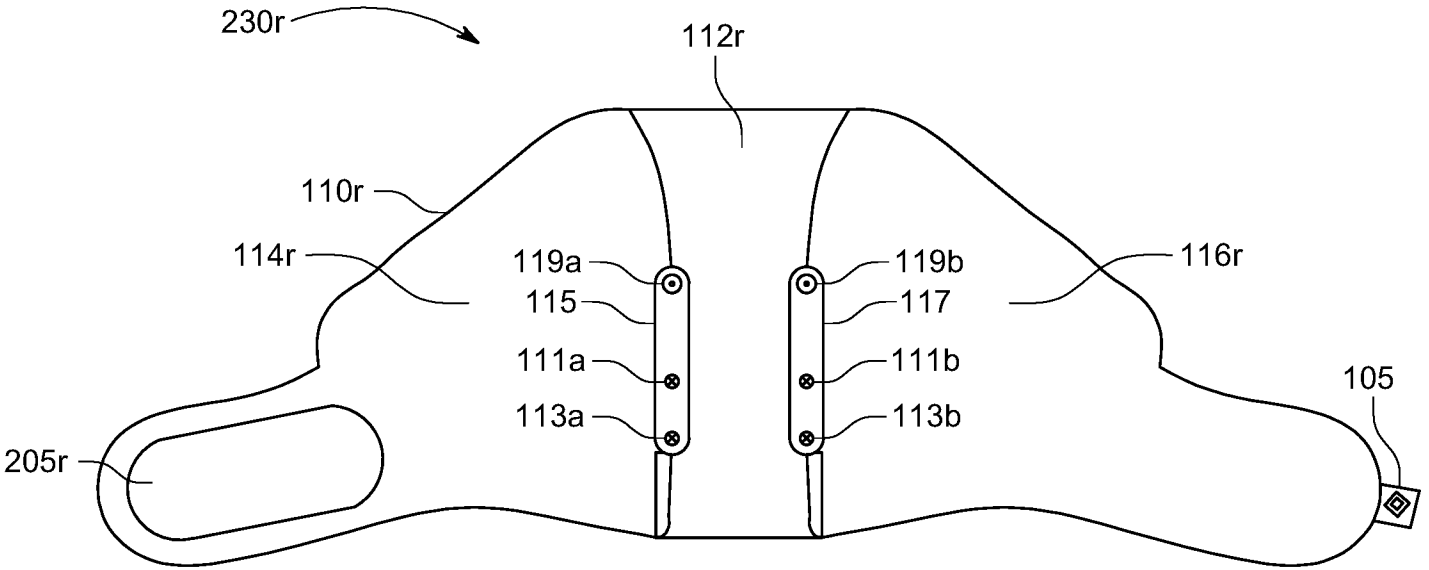
FIG. 2B is an exploded view depicting components of the rear exterior surface of the travel pillow, according to certain aspects of the present disclosure.

The neck portion 110 has a front exterior surface 110*f* (depicted in FIG. 2A) and a rear exterior surface 110*r* (depicted in FIG. 2B). The hood portion 120 has a front exterior surface 120*f* (depicted in FIG. 2A) and a corresponding rear exterior surface. The front exterior surfaces 110*f*, 120*f* and the rear exterior surfaces 110*r*, 120*r* can be made of any suitable material. For example, these surfaces can be made of fabric, synthetic materials such as neoprene, etc.

As previously discussed, the hood portion 120 and/or neck portion 110 may be flexible and allow the travel pillow 100 to be used with or without the hood portion 120 extending over the user's head. Additionally, in some embodiments, the hood portion 120 may be adjustable with respect to the neck portion 110. Such adjustment may allow the user to alter the distance that the hood portion 120 extends from the neck portion 110 such that more, or less, of the user's head is covered. In such embodiments, the rear exterior surface 110*r* of the neck portion 110 and/or the rear exterior surface 120*r* of the hood portion 120 include mating elements. The mating elements are configured to mate with one another such that the user can adjust the distance that the hood portion 120 extends from the neck portion 110. The mating elements can be arranged in pairs, groupings, etc. as desired. For example, mating elements of a first group of mating elements can pair with mating elements of a second group of mating elements. Additionally, the mating elements can be organized in pairs, such as the mating elements depicted in FIGS. 1B, 1C, and 1E.

Figure 1B:
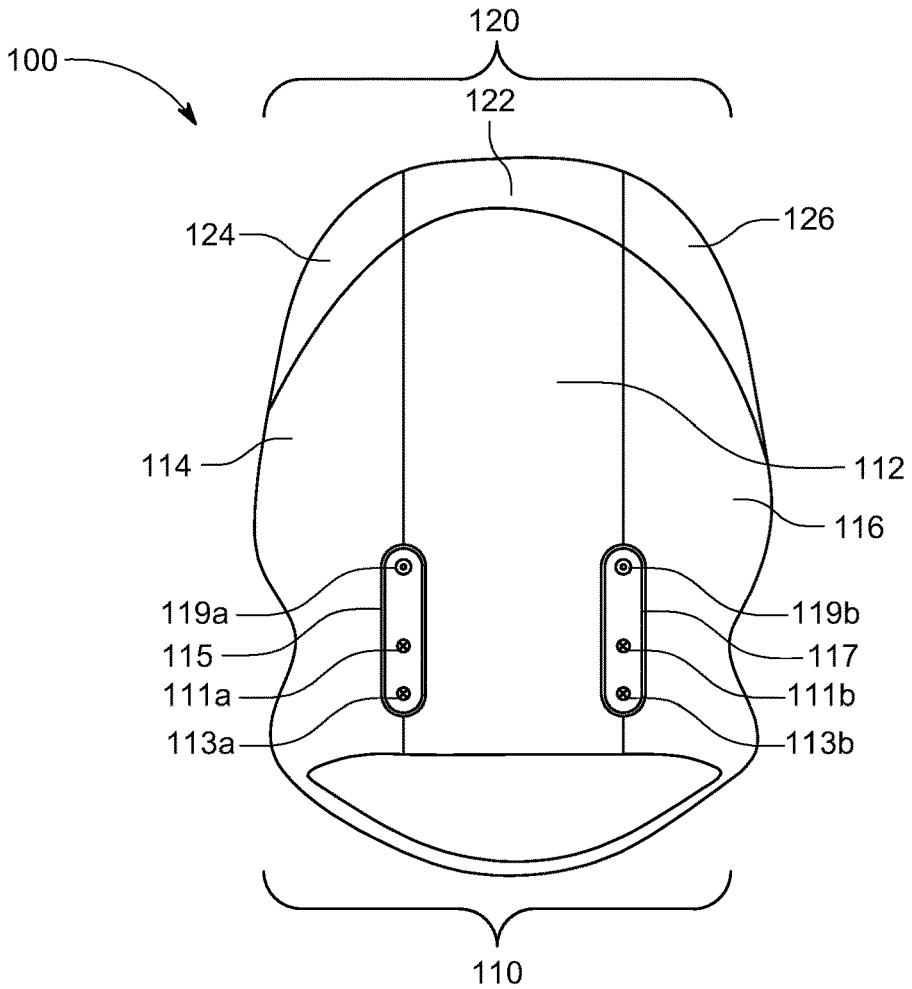
FIG. 1B is a rear view of the travel pillow, according to certain aspects of the present disclosure.
Figure 1C:
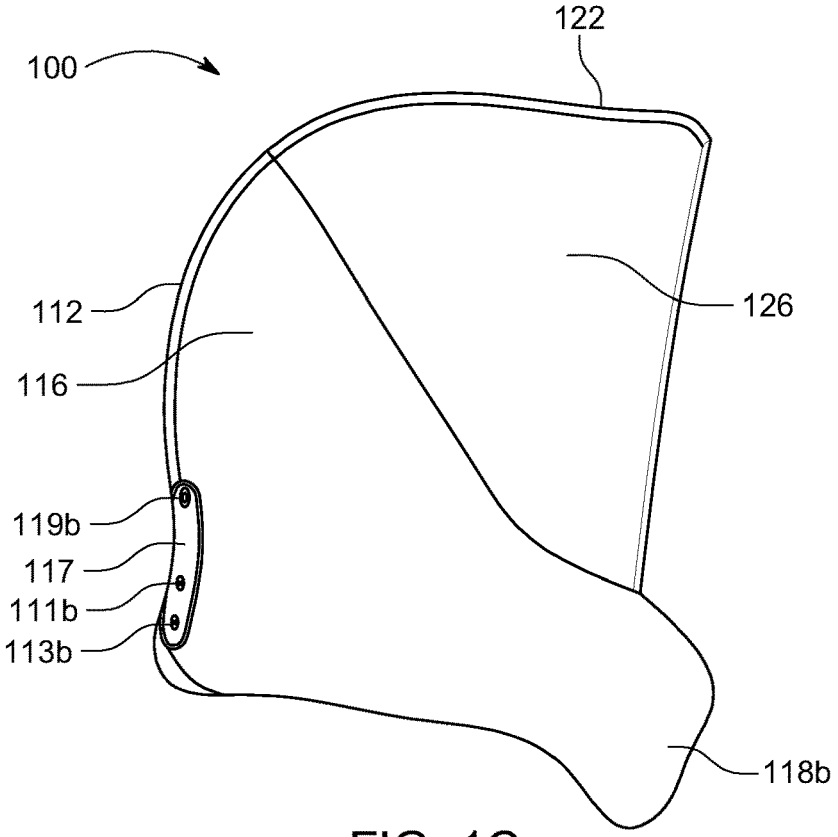
FIG. 1C is a right side view of the travel pillow, according to certain aspects of the present disclosure.
Figure 1D:
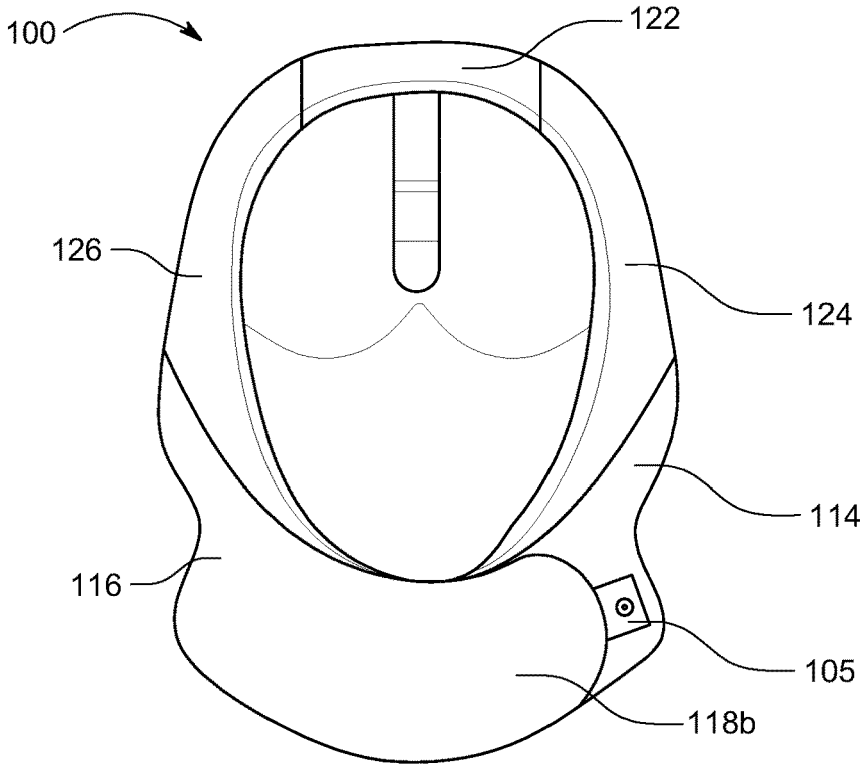
FIG. 1D is a front view of the travel pillow, according to certain aspects of the present disclosure.
Figure 1E:
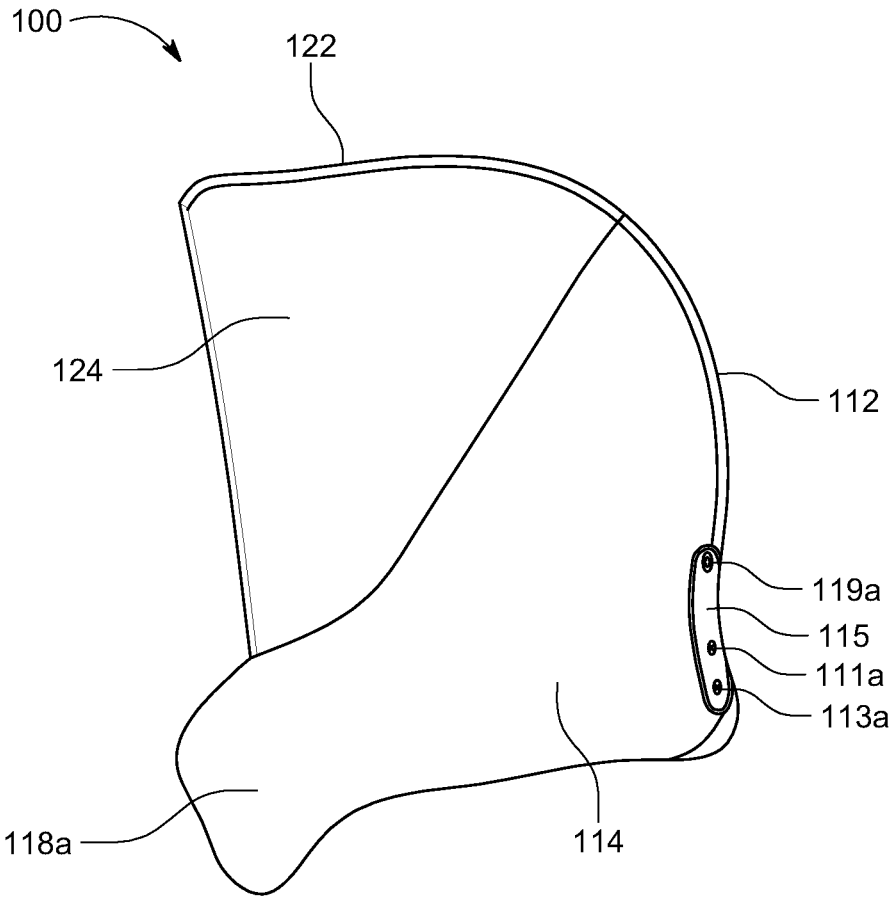
FIG. 1E is a left side view of the travel pillow, according to certain aspects of the present disclosure.

In the example embodiment shown in FIGS. 1B, 1C, and 1E, first mating elements 111*a/b* and 113*a/b* (i.e., a first group of mating elements) and second mating elements 119*a/b* (i.e., a second group of mating elements) are disposed on the neck portion 110. As depicted in the example provided in FIG. 1B, the upper first mating elements 111*a/b* and the lower first mating elements 113*a/b* form two separate groups of the first mating elements. Though the example depicted in FIG. 1B includes two groups of first mating elements (i.e., upper first mating elements 111*a/b* and lower first mating elements 113*a/b*), such is not required and there could be greater or fewer than two groups. The second mating elements 119*a/b* are configured to mate with the first mating elements 111*a/b* and 113*a/b* to effectively decrease the length of the hood portion 120 over the neck portion 110. Additionally, it should be noted that a "pair" or group of mating elements can include more than two mating elements. In the example depicted in FIGS. 1B, 1C, and 1E, the upper first mating elements (i.e., those mating elements denoted by reference numerals 111*a* and 111*b*) form a first pair of the first group of mating elements and the lower first mating elements (i.e., those mating elements denoted by reference numerals 113*a* and 113*b*) form a second pair of the first group of mating elements. Similarly, the second mating elements (i.e., those mating elements denoted by reference numerals 119*a* and 119*b*) form a pair of second group of mating elements.

In some embodiments, some, or all, of the mating elements are secured directly to the neck portion 110 and/or the hood portion 120. In other embodiments, a reinforcing layer can be positioned on any portion of the rear exterior surfaces 110*r*, 120*r*, and the mating elements secured to and/or through the reinforcing layer. For example, as can be seen in FIG. 1B, the neck portion 110 includes a first section 115 of reinforcing material and a second section 117 of the reinforcing material attached to the rear exterior surface 110*r*. In embodiments in which the neck portion 110 includes multiple segments, the first section 115 of reinforcing material and the second section 117 of reinforcing material can be located on, or between, the various segments. For example, in the example depicted in FIG. 1B, the first section 115 of reinforcing material is attached to the rear exterior surface 110*r* of the neck portion 110 between the left segment 114 and the middle segment 112, and the second section 117 of reinforcing material is attached to the rear exterior surface 110*r* of the neck portion 110 between the right segment 116 and the middle segment 112. One or more of the mating elements 111*a*, 113*a*, 119*a* can be located on the first section 115 of reinforcing material. Similarly, one or more of the mating elements 111*b*, 113*b*, 119*b* can be located on the second section 117 of reinforcing material. The reinforcing material can be any suitable material such as, cloth (e.g., webbing), plastic, leather, synthetic materials such as ultra suede, etc. In some embodiments, the sections 115 and 117 of the reinforcing material have a length between about 10 cm and about 14 cm and a breadth between about 1 cm and 3 cm.

FIG. 2A is an exploded view depicting components of the front exterior surface 230*f* of the example travel pillow 100, while FIG. 2B is an exploded view depicting components of the rear exterior surface 230*r* of the example travel pillow 100. While in the embodiments discussed herein, the front exterior surface 230*f* and the rear exterior surface 230*r* of the travel pillow 100 are described as having multiple segments, it may not necessarily be so (i.e., the front exterior surface 230*f* and the rear exterior surface 230*r* of the travel pillow 100 may be opposite surfaces of a single component).

As shown in FIG. 2A, the middle segments 112 and 122 of the neck portion 110 and the hood portion 120, respectively, are generally rectangular in shape. The middle segments 112 and 122 have lengths between about 27 cm and about 31 cm, respectively. The middle segments 112 and 122 have breadths between about 11 cm and about 15 cm, respectively.

The left segment 114 and the right segment 116 of the neck portion 110 are shaped as round-edged triangles with an elongated extension forming the first side portion 118*b* and the second side portion 118*a* respectively (see FIGS. 1C, 1D, and 1E in conjunction with FIG. 2A). The base lengths of the round-edged triangle are between about 25 cm and about 30 cm, while the lengths of the extensions forming the first side portion 118*b* and the second side portion 118*a* are between about 8 cm and about 12 cm.

The left segment 124 and the right segment 126 of the hood portion 120 are shaped as round-edged triangles having a base length between about 25 cm and about 30 cm and a height between about 23 cm and about 28 cm.

The middle segment 112 of the neck portion 110 has a front exterior surface 112*f* and a rear exterior surface 112*r*. The left segment 114 of the neck portion 110 has a front exterior surface 114*f* and a rear exterior surface 114*r*. The right segment 116 of the neck portion 110 has a front exterior surface 116*f* and a rear exterior surface 116*r*. The front exterior surfaces 112*f*, 114*f*, and 116*f* form the front exterior surface 110*f* of the neck portion 110. The front exterior surface 110*f* of the neck portion 110 and the front exterior surface 120*f* of the hood portion 120 form the front exterior surface 230*f* of the travel pillow 100. Although not shown, in some embodiments, the rear exterior surfaces 112*r*, 114*r*, and 116*r* form the rear exterior surface 110*r* of the neck portion 110, which along with the rear exterior surface 120*r* of the hood portion 120 form the rear exterior surface 230*r* of the travel pillow 100.

The first side portion 118*b* of the right segment 116 and the second side portion 118*a* are attachable through fasteners, which allow the user to adjust the travel pillow 100 such that the neck portion 110 comfortably and securely supports the user's head and/or neck. In the embodiment shown in FIGS. 2A-2B, the fastener is a hook-and-loop fastener where a patch of hook 205*f* (e.g., made from plastic) is disposed on the front exterior surface 116*f* and configured to fasten to a patch of loop 205*r* (e.g., made from plastic) disposed on the rear exterior surface 114*r*. This secures the first side portion 118*b* over the second side portion 118*a*, when the neck portion 110 is wrapped around a user's neck. The patch of hook 205*f* has a length between about 14 cm and about 18 cm and a breadth between about 4 cm and about 8 cm. The patch of loop 205*r* has a length between about 16 cm and about 24 cm and a breadth between about 4 cm and about 8 cm. The rear exterior surface 116*r* has the neck tag 105 coupled (e.g., by sewing) to an end thereof. The neck tag 105 has a length between about 4 cm and about 8 cm and a breadth between about 1 cm and about 4 cm.

Referring back to FIG. 2A, the middle segment 122 of the hood portion 120 has a front exterior surface 122*f* and a rear exterior surface 122*r*. The left segment 124 of the hood portion 120 has a front exterior surface 124*f* and a rear exterior surface 124*r*. The right segment 126 of the hood portion 120 has a front exterior surface 126*f* and a rear exterior surface 126*r*. The front exterior surfaces 122*f*, 124*f*, and 126*f* form the front exterior surface 120*f* of the hood portion 120.

FIGS. 3A-3C show exploded views of a liner assembly 300 coupled (e.g., by sewing) to the front exterior surface 120*f* of the hood portion 120 and to the front exterior surface 110*f* of the neck portion 110 (see FIG. 2A). The liner assembly 300 provides a protective inner shield that optionally includes an eye-mask for covering the eyes of a user, mating elements for rolling the neck portion 110 into the hood portion 120 for portability, and a cavity for accommodating a support assembly that provides cushioning support to a user's head and neck. While in some embodiments, the liner assembly 300 can be a single piece, the liner assembly 300 can also have multiple components, as shown in FIGS. 3A-3C where the liner assembly 300 includes a top liner assembly 310, a central liner assembly 320, a bottom liner assembly 330, and a neck liner assembly 340.

FIG. 3A shows an exploded view of the top liner assembly 310 of the hood portion 120 attachable to the central liner assembly 320 of the hood portion 120. FIG. 3B shows an exploded view of the central liner assembly 320 attachable to the bottom liner assembly 330 of the hood portion 120. FIG. 3C shows an exploded view of the bottom liner assembly 330 attachable to the neck liner assembly 340 of the neck portion 110. The neck liner assembly 340 is coupled (e.g., by sewing) to the front exterior surface 110*f* of the neck portion 110. The top liner assembly 310, the central liner assembly 320, the bottom liner assembly 330, and the neck liner assembly 340 are made from a suitable material such as, cloth, leather, polyester materials such as ponte knit, etc.

Referring to FIG. 3A, the top liner assembly 310 includes two pieces—an outer lining 312 and an inwardly foldable lining 314, which is attached about only a portion of the periphery of the outer lining 312. The outer lining 312 is shaped as a whale's tail, while the inwardly foldable lining 314 is generally semicircular in shape with a notch along the base diameter, as shown in FIG. 3A. In some embodiments, the outer lining 312 has a length between about 50 cm and about 65 cm, and a radial breadth between about 20 cm and about 28 cm.

In some embodiments, the outer lining 312 includes a pocket portion 316*a* shaped to accommodate the inwardly foldable lining 314. The inwardly foldable lining 314 is configured to be used as an eye-mask by the user, by pulling on a strap 315 coupled thereto (e.g., by sewing at both ends). In some embodiments, the strap 315 has a length between about 10 cm and 15 cm, and a breadth between about 2 cm and about 3 cm. In some embodiments, the strap 315 is made from a suitable material such as a cloth, leather, a synthetic material such as ultra suede, etc. The inwardly foldable lining 314 has an outer surface made from a suitable material (e.g., cloth, leather, polyester materials such as ponte knit, etc.) and an inner surface made from spandex that covers the user's eye, when used as an eye-mask. The inwardly foldable lining 314 is configured to be flipped under the outer lining 312 and accommodated within the pocket portion 316*a*, when not used as an eye-mask. In some embodiments, the pocket portion 316*a* has a length between about 35 cm and about 45 cm, and a radial breadth between about 15 cm and about 25 cm. The inwardly foldable lining 314 is configured to be used as an eye-mask by the user, by pulling on a strap 315 coupled thereto (e.g., by sewing at both ends). The inwardly foldable lining 314 includes a compartment 316*b*, where a neoprene pad 318 is placed. In some embodiments, the neoprene pad 318 has a length between about 35 cm and about 40 cm, and a radial breadth between about 15 cm and about 18 cm.

In one embodiment, the travel pillow 100 is configured to be rolled onto itself for, for example, storage or transport. For example, the hood portion 120 can wrap about the neck portion 110. In such embodiments, the outer lining 312 can include complimentary mating elements 317*a/b* that are configured to mate with the first mating elements 111*a/b* and/or 113*a/b*. This allows the neck portion 110 to be rolled into and within the hood portion 120 to secure the travel pillow in the wrapped configuration.

Continuing to refer to FIG. 3A, the top liner assembly 310 is attachable to the central liner assembly 320. The central liner assembly 320 includes a central panel 322, a left panel 324, and a right panel 326. The central panel 322 generally has a rectangular shape with a length between about 25 cm and about 30 cm and a breadth between about 10 cm and about 15 cm. The left panel 324 and the right panel 326 generally have an oval shape with a sharp-edged tip, as shown in FIG. 3A. Each of the left panel 324 and the right panel 326 has a major axis between about 20 cm and about 28 cm and a minor axis between about 12 cm and about 17 cm.

Referring to FIG. 3B, the left panel 324 has a foam layer 323 inserted therein, and the right panel 326 has a foam layer 327 inserted therein. The central liner assembly 320 is attachable to the bottom liner assembly 330, as shown in FIG. 3B. The bottom liner assembly 330 has a central panel 332, a left panel 334, and a right panel 336. The central panel 332 generally has a rectangular shape with a length between about 15 cm and about 20 cm and a breadth between about 10 cm and about 15 cm. The left panel 334 and the right panel 336 generally have a triangular shape with a sharp edge at one or more ends, as shown in FIG. 3B. Each of the left panel 334 and the right panel 336 has a height between about 20 cm and about 28 cm and a base between about 15 cm and about 18 cm.

Figure 3D:
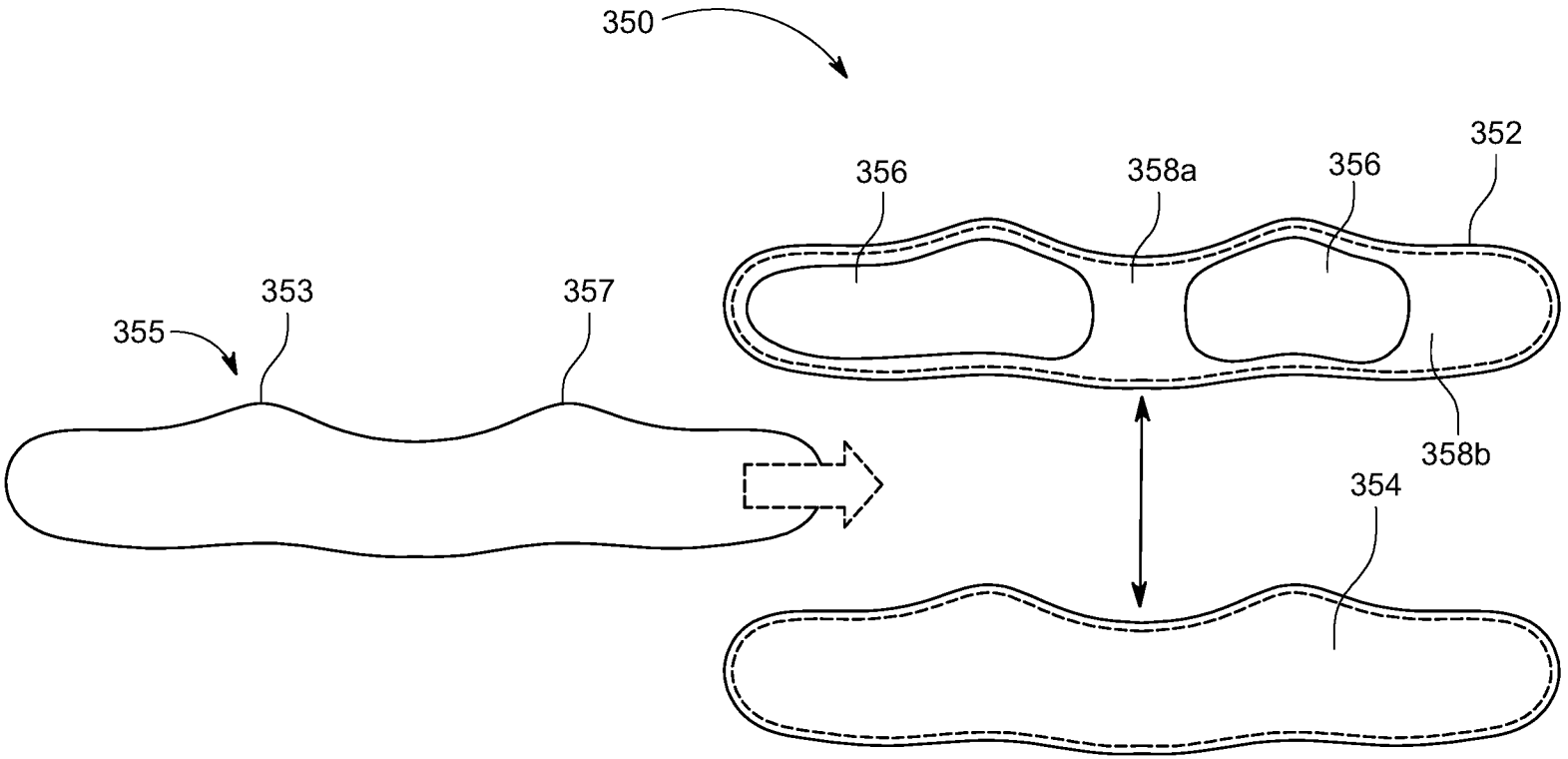
FIG. 3D is an exploded view of a support assembly insertable within a cavity of the neck portion, according to certain aspects of the present disclosure.

Referring to FIG. 3C, the bottom liner assembly 330 is attachable to the neck liner assembly 340 of the neck portion 110. The neck liner assembly 340 includes an outer surface 342*a*, an inner surface 342*b*, and a cavity 345 bounded by the inner surface 342*b*. In some embodiments, the cavity 345 is accessible through a zipper 343 and is configured to accommodate a support assembly 350, as shown in FIG. 3D. In some embodiments, the zipper 343 has a length between about 45 cm and about 55 cm. In some embodiments, the cavity 345 is disposed around a lower half of the neck portion 110.

FIG. 3D shows an exploded view of the support assembly 350. The support assembly 350 is insertable within the cavity 345 of the neck portion 110, as alluded to previously. The support assembly 350 provides cushioning support to the user's head and neck, when the travel pillow 100 is used. The support assembly 350 includes an outer covering 352 and a foam insert 355 configured to be disposed within the outer covering 352. Accordingly, the outer covering 352 is shaped similarly as the foam insert 355. In some embodiments, the outer covering 352 has a length between about 80 cm and about 90 cm. The foam insert 355 interfaces with an inner surface 354 of the outer covering 352, and has peak portions 353 and 357 for accommodating the shape of the user's neck.

In some embodiments, the support assembly 350 may be removed from the cavity 345 of the neck portion 110. For example, the support assembly 350 can be interchanged with different support assemblies (not shown) that have different properties. For example, the different support assemblies can have varying stiffnesses (i.e., the foam insert of the support assembly can have different firmness properties), geometries, sizes, contours, etc. Such removability can allow for cleaning/laundering of the support assembly 350 and/or the interchangeability of support assemblies 350.

A padding layer 356 is disposed between the foam insert 355 and the inner surface 354. In some embodiments, the padding layer 356 is asymmetrically distributed along a length of the support assembly 350 such that the padding layer 356 is absent from sections 358*a* and 358*b* of inner surface 354 that interfaces with the human neck between the peak portions 353 and 357 of the foam insert 355. In some embodiments, the sections 358*a* and 358*b* have a length between about 3.5 cm and about 5.5 cm. The asymmetric distribution of the padding layer 356, along with two peak portions 353 and 357 of the foam insert 355 provides optimal comfort and support as the first side portion 118*b* overlaps the second side portion 118*a*, when the neck portion 110 is wrapped around the human neck. The support assembly 350 within the cavity 345 is washable and replaceable simply by accessing the cavity 345 through the zipper 343.

Figure 4C:
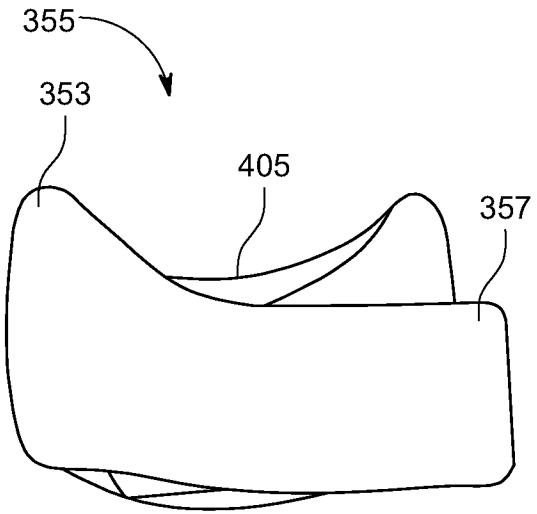
FIG. 4C is a front view of the foam insert of FIG. 4A, according to certain aspects of the present disclosure.
Figure 4B:
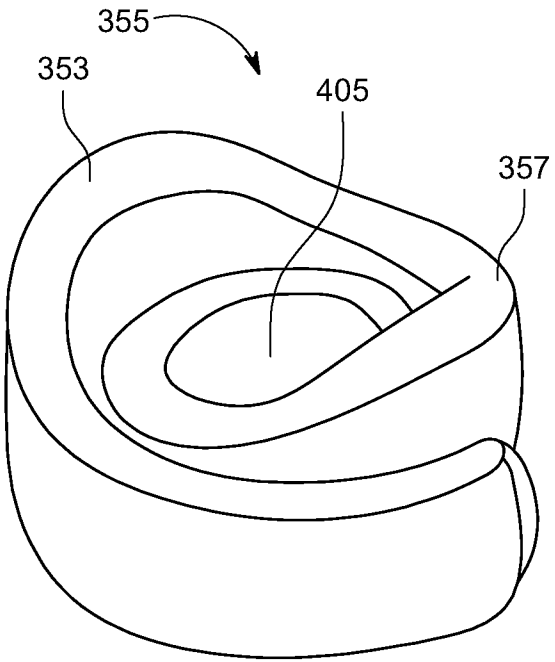
FIG. 4B is a perspective view of the foam insert of FIG. 4A, according to certain aspects of the present disclosure.
Figure 4A:
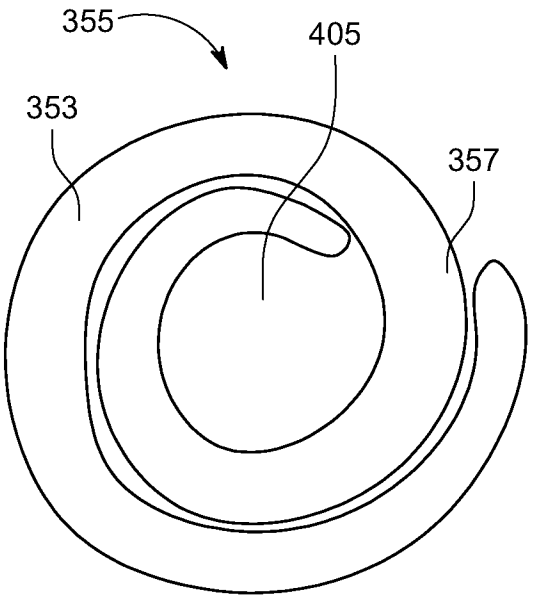
FIG. 4A is a top view of a foam insert of support assembly of FIG. 3E, according to certain aspects of the present disclosure.

FIGS. 4A, 4B, and 4C show a top view, a perspective view, and a front view, respectively, of the foam insert 355. In one embodiment, the foam insert 355 provides the main cushioning support for the support assembly 350 and can be configured to provide customized comfort and support based on needs and preferences of the user. In different embodiments, different densities of foam may be used for the foam insert 355. In different embodiments, the foam insert 355 includes one or more peak portions that can have different sizes and heights based on the dimensions of the user's neck and be positioned in different ways to optimize support and comfort of the user around the neck. In the embodiments described with respect to FIGS. 4A-4C, the foam insert 355 includes two peak portions 353 and 357 that are similarly sized and symmetrically distributed between about one hundred and sixty degrees and about two hundred degrees apart from one another, when the travel pillow 100 is wrapped around a human neck. In other embodiments, there may be three peak portions that are either not similarly sized or not symmetrically distributed. A central hollow portion 405 accommodates the human neck, when the travel pillow 100 is in use.

In some embodiments, the foam insert 355 has a length between about 65 cm and about 90 cm when fully straight, and a diameter between about 8 cm and about 12 cm when fully curled in the cavity 345 during use. In some embodiments, the foam insert 355 has a height between about 3 cm and about 6 cm.

In some embodiments, the travel pillow comprises a neck portion including a cavity, a hood portion extending from the neck portion, and a support assembly insertable within the cavity, the support assembly comprising: an outer covering; a foam insert disposed within the outer covering; and a padding layer disposed between the foam insert and an inner surface of the outer covering, the padding layer asymmetrically distributed along a length of the support assembly.

In some embodiments, the travel pillow comprises a neck portion including a cavity and a rear exterior surface having one or more first mating elements; a hood portion extending from the neck portion, the hood portion including one or more second mating elements configured to mate with at least one of the one or more first mating elements when the neck portion can be rolled into the hood portion; and a support assembly insertable within the cavity, the support assembly comprising: an outer cover; a foam insert disposed within the outer covering; and a padding layer disposed between the foam insert and an inner surface of the outer covering.

In some embodiments, the travel pillow comprises a neck portion including a cavity, a hood portion extending from the neck portion and including an inwardly fordable lining, and a support assembly insertable within the cavity, the support assembly comprising: an outer covering; a foam insert disposed within the outer covering; and a padding layer disposed between the foam insert and an inner surface of the outer covering.

In some embodiments, a support assembly is configured to be placed within the travel pillow, the support assembly comprising: an outer covering; a foam insert disposed within the outer covering; and a padding layer disposed between the foam insert and an inner surface of the outer covering.

Embodiments of the travel pillow described herein can be advantageously used to improve user comfort and portability while traveling. Particularly, the travel pillow can be personalized and customized to cater to the user's needs and preferences for resting during travel, which could be otherwise uncomfortable.

Although the disclosed embodiments have been illustrated and described with respect to one or more implementations, equivalent alterations and modifications will occur or be known to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

While various embodiments of the present disclosure have been described above, it should be understood that they have been presented by way of example only, and not limitation. Numerous changes to the disclosed embodiments can be made in accordance with the disclosure herein, without departing from the spirit or scope of the disclosure. Thus, the breadth and scope of the present disclosure should not be limited by any of the above described embodiments. Rather, the scope of the disclosure should be defined in accordance with the following claims and their equivalents.

What is claimed is:

1. A travel pillow comprising:
- a neck portion including a cavity;
- a hood portion extending from the neck portion; and
- a support assembly insertable within the cavity, the support assembly comprising:
  - an outer covering;
  - a foam insert affixed within the outer covering; and
  - a padding layer disposed between the foam insert and an inner surface of the outer covering, wherein the padding layer is asymmetrically distributed along a length of the support assembly.

2. The travel pillow of claim 1, wherein the neck portion includes a first side portion and a second side portion, and wherein the first side portion is configured to overlap the second side portion when the neck portion is wrapped around a user's neck.

3. The travel pillow of claim 2, wherein the padding layer is absent from the support assembly that interfaces with a section of the first side portion that overlaps the second side portion.

4. The travel pillow of claim 2, wherein the first side portion and the second side portion include hook-and-loop fasteners to secure the first side portion to the second side portion.

5. The travel pillow of claim 1, wherein the neck portion includes one or more first mating elements disposed on a rear exterior surface thereof.

6. The travel pillow of claim 5, wherein the rear exterior surface of the neck portion includes one or more second mating elements that are attachable to at least one of the one or more first mating elements.

7. The travel pillow of claim 5, wherein the hood portion includes one or more third mating elements configured to mate with at least one of the one or more first mating elements when the neck portion can be rolled into the hood portion.

8. The travel pillow of claim 1, wherein the hood portion comprises a top liner assembly, a central liner assembly, and a bottom liner assembly.

9. The travel pillow of claim 8, wherein each of the central liner assembly and the bottom liner assembly includes a left panel, a central panel, and a right panel, wherein the central liner assembly includes at least one foam layer on each of the left panel and the right panel.

10. The travel pillow of claim 8, wherein the top liner assembly of the hood portion includes an inwardly foldable lining.

11. A travel pillow comprising:
- a neck portion including a cavity and a rear exterior surface having one or more first mating elements,
- a hood portion extending from the neck portion, the hood portion including one or more complementary mating elements located on an inner surface of the hood portion and configured to mate with at least one of the one or more first mating elements, wherein the neck portion is configured to be rolled into the hood portion; and a support assembly insertable within the cavity, the support assembly comprising:

an outer covering;

a foam insert disposed within the outer covering; and a padding layer disposed between the foam insert and an inner surface of the outer covering.

12. The travel pillow of claim 11, wherein the neck portion includes a first side portion and a second side portion, and wherein the first side portion is configured to overlap the second side portion when the neck portion is wrapped around a user's neck.

13. The travel pillow of claim 12, wherein the padding layer is asymmetrically distributed along a length of the support assembly.

14. The travel pillow of claim 13, wherein the padding layer is absent from the support assembly that interfaces with a section of the first side portion that overlaps the second side portion.

15. The travel pillow of claim 12, wherein the first side portion and the second side portion include hook-and-loop fasteners to secure the first side portion to the second side portion.

16. The travel pillow of claim 11, wherein the rear exterior surface of the neck portion includes one or more third mating elements that are attachable to at least one of the one or more first mating elements.

17. The travel pillow of claim 11, wherein the hood portion comprises a top liner assembly, a central liner assembly, and a bottom liner assembly.

18. The travel pillow of claim 17, wherein each of the central liner assembly and the bottom liner assembly includes a left panel, a central panel, and a right panel, wherein the central liner assembly includes at least one foam layer on each of the left panel and the right panel.

19. The travel pillow of claim 17, wherein the top liner assembly of the hood portion includes an inwardly foldable lining.

20. The travel pillow of claim 11, wherein the foam insert includes two peak portions that are similarly-sized and symmetrically distributed between one hundred and sixty degrees and two hundred degrees apart from one another.

* * * * *